United States Patent [19]

Hanyu et al.

[11] Patent Number: 4,960,062

[45] Date of Patent: Oct. 2, 1990

[54] SEWING MACHINE AUTOMATIC THREAD TENSION DEVICE WITH THREAD ELONGATION DETECTOR

[75] Inventors: Susumu Hanyu; Noboru Kasuga; Kazumasa Hara; Mikio Koike; Mitsuru Ninijima, all of Tokyo, Japan

[73] Assignee: Janome Sewing Machine Co. Ltd., Tokyo, Japan

[21] Appl. No.: 211,694

[22] Filed: Jun. 27, 1988

[30] Foreign Application Priority Data

Jul. 3, 1987 [JP] Japan ..... 62-165224

[51] Int. Cl.[5] ..... D05B 47/04

[52] U.S. Cl. ..... 112/255

[58] Field of Search ..... 112/241, 246, 254, 255

[56] References Cited

U.S. PATENT DOCUMENTS 4,377,980 3/1983 Hanyu et al. ..... 112/229 X
4,700,644 10/1987 Eguchi et al. ..... 112/255
4,702,185 10/1987 Hanyu et al. ..... 112/254
4,793,723 12/1988 Hara et al. ..... 112/254

*Primary Examiner*—Andrew M. Falik
*Attorney, Agent, or Firm*—Michael J. Striker

[57] ABSTRACT

A sewing machine includes an automatic thread tension adjusting device comprising an upper thread tension member arranged in an a thread running path between an upper thread source and a main thread take-up lever. An auxiliary thread take-up lever is arranged in the upper thread running path between the main thread take-up lever and a needle holding the upper thread. A thread engaging part guides the upper thread. A thread presser is arranged laterally of the upper thread running path between the main and auxiliary thread take-up levers and normally clamps the upper thread. A detector detects a predetermined rotation phase of a drive shaft of the machine and thread elongation, respectively, and generates respective electric signals. A control circuit causes the thread presser to release the upper thread in response to the electric signals generated by the detector.

3 Claims, 5 Drawing Sheets

SEWING MACHINE AUTOMATIC THREAD TENSION DEVICE WITH THREAD ELONGATION DETECTOR

FIELD OF THE INVENTION

The present invention relates to a sewing machine with an automatic thread tension device having a stitch compensating device which supplies an upper thread of a proper length required for forming stitches.

BACKGROUND OF THE INVENTION

Japanese Pat. application No. 251,589/86 corresponding to U.S. Pat. application Ser. No. 07/312,899, U.S. No. 4,892,048 discloses a sewing machine which supplies automatically an upper thread of an amount required to form stitches by an intermittently operating presser device arranged in an upper thread running path between a thread tension device and a take-up lever and is operated in a predetermined phase of stitching.

In conventional sewing machines such as disclosed in the application Ser. No. 312,899, it was difficult to exactly cope with various elongation characteristics of various types of threads and differences in thickness of fabrics. Therefore, the elongations were dealt with by G.C.M. (greatest common measure). Namely, standard types of threads, fabric, and needle were employed to tentatively sew zigzag and/or straight stitches. If the stitches so formed showed no interconnection of upper and lower threads on the upper and lower face of a fabric, the sewing machine has been considered practically good.

U.S. Pat. application Ser. No. 07/209,856 pending discloses an automatic thread tension control method for a sewing machine, wherein a conventional thread tension device and an intermittently operated thread clamping or holding device are used in combination. As it is usual, the thread tension device is adjusted in accordance with the stitching conditions including a type of patterns to be stitched, the thickness of the fabric, a fabric feeding amount, etc. The thread tension device is adjusted and may be set with a presser to a cotton thread and to another kind of the thread such as a polyester thread. In this case, the thread elongations may be observed in the cotton threads and polyester thread, respectively, when a thread take-up lever comes to the upper dead point thereof. Such phenomenon will cause the formation of the shrunk seam. It is therefore required that the amount of the thread corresponding to the elongation, that is, a lacked amount is supplied from the thread source. Moreover it is required that such difference of the elongation depending upon the kind of the threads be compensated by controlled supply of the thread. In U.S. Pat. application Ser. No. 07/209,856 a thread damping device is provided for these purposes.

SUMMARY OF THE INVENTION

The object of the invention is to provide a sewing machine having a device for automatically adjusting thread tension. Another object of the invention is to provide a more precise controlled supply of thread to compensate for difference in elongation which may result from the type of the thread used and a difference in fabric thickness. The objects of the invention are achieved by providing a sewing machine comprising a needle reciprocating vertically;

a thread loop catching instrument for forming lock stitches in cooperation with the needle; and a take-up lever vertically operated in synchronism with the needle.

The thread tension adjusting device comprises means for detecting a rotation phase of a drive shaft;

means for detecting thickness of a fabric to be sewed; and means for detecting an elongation of an upper thread An intermittently operated presser device is provided in an upper thread running path between the thread tension device and the thread take-up lever. The presser device clamps the upper thread and operates to release the upper thread in a predetermined rotational phase (angular position) of the drive shaft to supply a predetermined amount of the upper thread. The presser device is controlled by control means actuated in response to electric signals from respective detecting means.

One of the detectors detects the rotation phase of the drive shaft and the other of the detectors detects the fabric thickness. With respect to an elongation length of the upper thread, a stress sensor is used to detect stress due to the elongation of the thread generated at the upper dead point of the take-up lever when the take-up lever goes down from the upper dead point. Each of detected data controls the thread releasing duration of the upper thread intermittent presser device. The amount of slack thread of the take-up lever is absorbed by an auxiliary take-up lever.

DETAILED DESCRIPTION OF PREFERRED EMBODIMENTS

Figure 1:
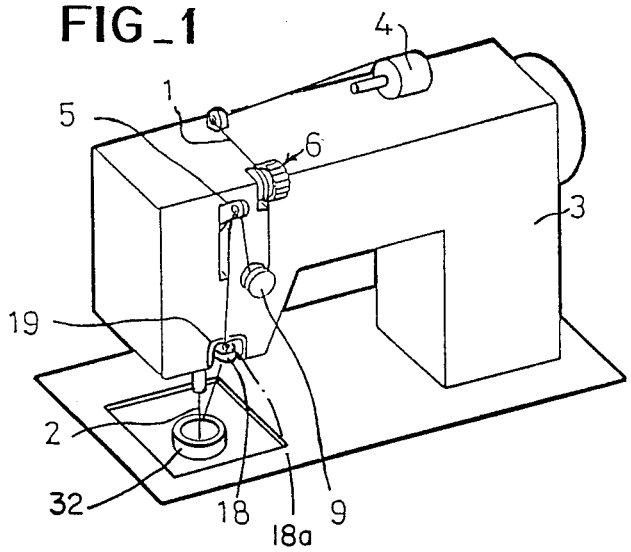
FIG. 1 is a perspective view of a sewing machine.
Figure 2:
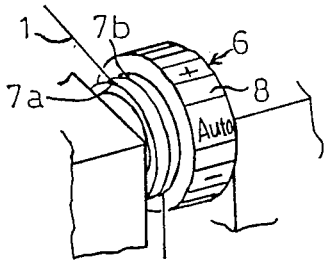
FIG. 2 is an enlarged view of an upper thread tension device of precise adjustment.

A sewing machine is provided with a thread loop catching instrument 32 which forms stitches of straight stitching in cooperation with a needle 2 moving in vertical directions with respect to a sewing machine frame 3, and is provided with a known take-up lever 5 arranged in an upper thread running path which extends from a thread supply source and the needle 2, the take-up lever being driven in synchronism with the needle 2.

An upper thread tension device 6 for precisely adjusting the tension of the upper thread has the same structure as the known device, and holds under pressure an upper thread 1 from the thread source 4 between a pair of thread tension disks *7a, 7b,* while a thread tension dial 8 is rotated to adjust the pressure of a spring for imparting tension to an upper thread 1.

Figure 4:
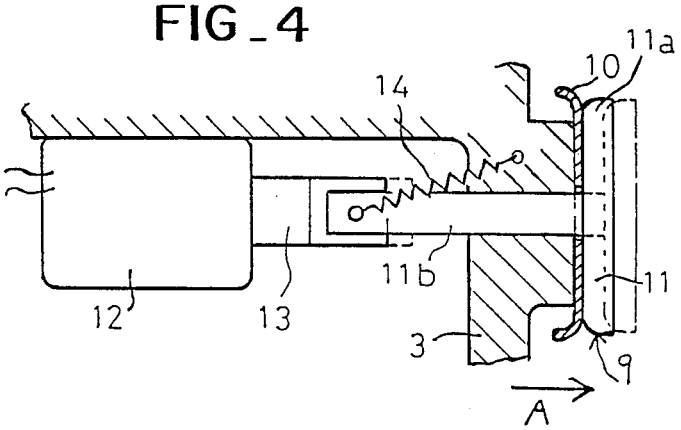
FIG. 4 is a view explaining an intermittent presser device.
Figure 5:
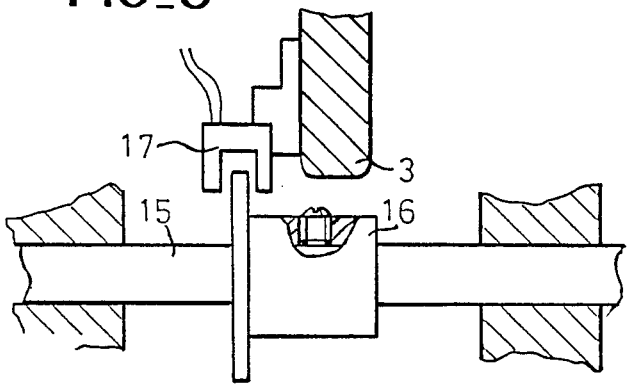
FIG. 5 shows a detecting device for phases of an upper shaft.

An intermittent presser device 9 has a structure as shown in FIG. 4. A thread holding disk 10 contacts this device 9. A presser shaft 11 has a brimed portion 11*a* and a shaft portion 11*b* passing through the thread holding disk 10. The shaft communicates with the plunger 13 of a solenoid 12 secured to the machine frame 3. A spring 14 is provided between an end of the shaft and the machine frame 3 to bias the shaft in a direction of an arrow A.

A rotary disk 16 is fixed on an upper shaft 15 rotatably supported by the machine frame 3, and a photointerrupter 17 is fixed to the machine frame 3 and surrounds the rotary disk 16. The rotary disk 16 and the photointerrupter 17 form means for detecting a rotation phase of the upper shaft 15. A signal from the photointerrupter 17 is input in a calculating device (not shown) incorporated within the machine frame 3. The calculating device is connected to the solenoid 12.

An auxiliary take-up lever 18 is disposed between the take-up lever 5 and the needle 2, which passes through a thread guide 19 and has a thread hole 18*a* at its end portion, and the lever 18 is secured at its other end to a cam shaft 20 which is rotatably supported to the machine frame 3. The cam shaft 20 has a lever 21 with a pawl 21*a* which is always rotated in a direction of an arrow B to energize a cam 22 by a spring 36 between the auxiliary take-up lever 18 and the machine frame 3.

The control of advancing of the upper thread will be explained with reference to FIGS. 6 to 8.

Figure 7:
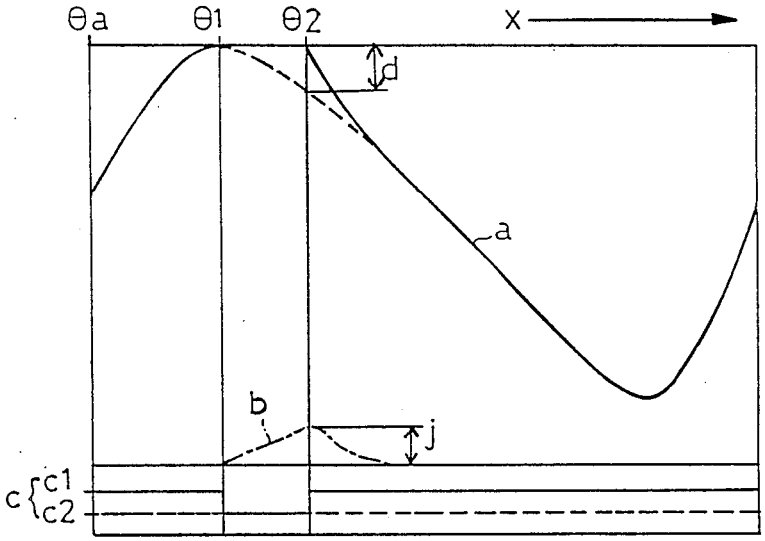
FIG. 7 is a diagrammatic view showing an upper thread supplied by the take-up lever and its slack timingly absorbed by the auxiliary take-up lever in accordance with phases of rotation of the upper drive shaft.
Figure 8A:
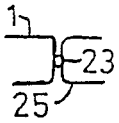
FIG. 8A shows a crossing point of interlocked upper and lower threads at the center of the fabric.
Figure 8B:
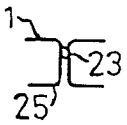
FIG. 8B shows a crossing point of interlocked upper and lower stitches upward from the center of the fabric thickness.
Figure 8C:
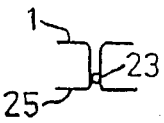
FIG. 8C shows a crossing point of interlocked upper and lower threads downward from the center of the fabric thickness.

The abscissa X of FIG. 7 shows rotation phase of the upper shaft where the upper dead point $\theta$ a detected by the detector is 0°. The ordinate Y denotes the upper thread supplying movement of the thread take-up lever 5.

In FIG. 7, "a" is a curve of the slack of the thread from the take-up lever, "b" is a curve of absorbing the upper thread as a result of operation of the auxiliary take-up lever 18. "C" in FIG. 7 is an operating curve of the intermittent presser device 9, where curve C1 indicates a condition when the intermittent presser device 9 is operative and C2 indicates a condition when it is inoperative.

The take-up lever 5 moves vertically by rotation of the upper shaft 15 and acts on the take-up lever to draw the upper thread according to curve a shown in FIG. 7. At the operation according to curve C1, the solenoid 12 is energized as shown with the solid line in FIG. 4, by a signal communicated from a calculating device and pulls the pressing shaft 11 in a direction opposite to that shown by the arrow A, and the intermittent presser device 9 holds under pressure the upper thread 1 between the brimed portion 11*a* and the holding disk 10.

In the inoperative condition of the presser device characterized by the curve C2, the solenoid 12 is deenergized as shown with the dotted line in FIG. 4 by a signal from the calculating device. The plunger 13 and the pressing shaft 11 move in the direction of the arrow A by the force of the spring 14, and the intermittent presser device 9 releases the upper thread 1.

The elongation caused at tightening the stitches formed by a bobbin is not taken into account for convenience. Feeding of the fabric is delayed slightly so that the fabric is fed and the phase $\theta$ 1 of the upper dead point of the take-up lever and the feeding is finished at the phase $\theta$ 2 when the needle comes to the center in thickness of the fabric.

At the upper dead point phase shown with the phase $\theta$ a, the fabric is not fed as discussed above, and the intermittent presser device 9 is in the operative condition characterized by the curve C1, and holds the thread between the brimed portion 11*a* of the shaft 11 and the disk 10.

Since the pawl 21*a* of the lever 21 rotates in the direction of the arrow B by the spring 36 and contacts the part of the smallest diameter of the cam 22, the auxiliary take-up lever 18 rotates in a direction opposite to that shown by the arrow C, and the thread hole 18*a* of the auxiliary take-up lever 18 is positioned beyond the thread guide 19 as shown by the dotted line in FIG. 1.

While the above mentioned condition of the lever 18 is maintained until a next upper dead point phase $\theta$ 1 of the take-up lever 5. In the meantime, the take-up lever 5 moves upwardly to absorb the slackened upper thread portion between the intermittent presser device 9 and the stitches for reducing the slack of the upper thread to a minimum at the phase $\theta$ 1. Thereby the stitch is tensioned. The thread running path at this time is as shown in FIG. 6(*a*). The upper thread passes through the thread guide 19 (point e) — the needle eye 2*a* (point b) — the crossing point 23 (point f) of the upper and lower threads, with the upper thread remaining in the tensioned condition.

The stitches are tightened at the upper dead point $\theta$ 1 of the take-up lever 5, and the intermittent presser device 9 is in inoperative condition characterized by the curve C2 so that the upper thread, held between the brim 11*a* of the pressing shaft 11 and the holding disk 10 is released. The fabric is fed for a period of the phase $\theta$ 2 where the needle eye 2*a* comes to the center in the fabric thickness, and the feeding is finished at the phase $\theta$ 2 while the intermittent presser device 9 is in operative condition characterized by the curve C1 to hold the thread under pressure. The phase $\theta$ 2 is as shown in FIG. 6(*b*), and the fabric is fed by the amount m, and the needle eye 2*a* (point g) is at the center of the fabric thickness.

Therefore, a length of the upper thread 1 corresponding to the feeding amount m and the fabric thickness t, is required between the thread source 4 and the stitches, the intermittent presser device 9 releases the thread, and the thread is drawn from the source 4 and is imparted with slight tension by the upper thread tension device 6 of precise adjustment.

Slack amount of the thread increases as shown with the dotted line in FIG. 7, as the take-up lever 5 moves downward from the upper dead point phase $\theta$ 1, and a slack amount d is generated between the phases $\theta$ 1 and $\theta$ 2, that is, for a period of the phase when the upper thread is supplied from the thread source. In the described embodiment, the auxiliary take-up lever 18 absorbs the thread slack resulting from downward movement of the take-up lever 5.

Figure 3:
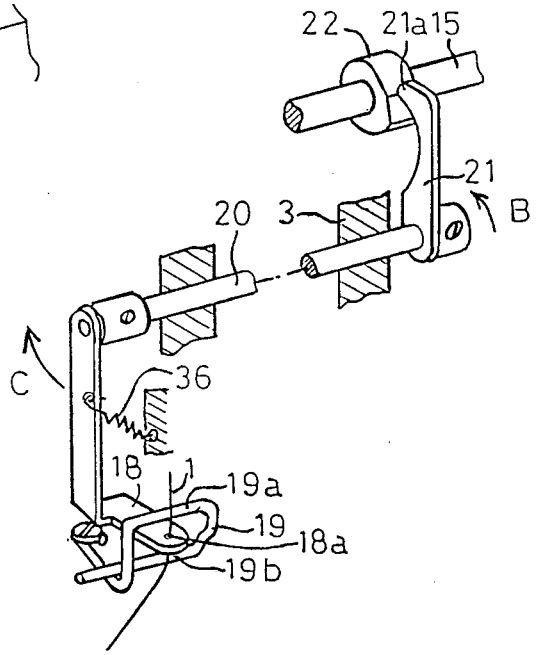
FIG. 3 is a view explaining an auxiliary take-up lever.
Figure 9:
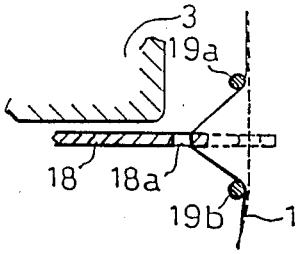
FIG. 9 is an explanatory view of operations of the auxiliary take-up lever.

The pawl of the lever 21 moves from the portion of the smallest diameter to the portion of the largest diameter of the cam 22 by the rotation of the upper shaft 15. The lever 21 is rotated in a direction opposite to that shown by the arrow B of FIG. 3, and the auxiliary take-up lever 18 is rotated in the direction of the arrow C, and the thread eye 18*a* is moved inwardly of the thread guides 19*a*, 19*b*, as shown with the solid line in FIG. 9, so as to absorb the thread by an amount j equivalent to the slack amount d. Therefore, a corresponding length of the upper thread need be supplied when the fabric is fed, and a required length is supplied from the thread source when the thread between the phases $\theta$ 1 and $\theta$ 2 is tightened.

At the phase $\theta$ 2 after supplying the thread, the intermittent presser device 9 is operative according to the curve C1, and the solenoid is energized and holds the thread and stops supplying of the upper thread. The auxiliary take-up lever 18 follows the movement of the pawl 21*a* from the largest diameter portion to the smallest diameter portion of the cam 22 so as to rotate the lever 21 in the direction of the arrow B and rotate the auxiliary take-up lever 18 in the direction opposite to that shown by the arrow C, so that the lever 18 moves from the position shown with the solid line to the position shown with the dotted line in FIG. 9 to reduce the absorbing amount of the upper thread 1 and supply the thread to the path and increase, as shown in FIG. 7, the slack of the thread by the take-up lever to meet the conventional slack a.

Figure 6A:
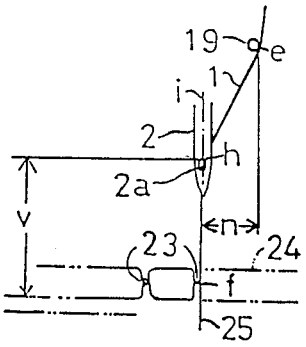
FIG. 6A shows a thread running path during the phase of feeding the fabric.
Figure 6B:
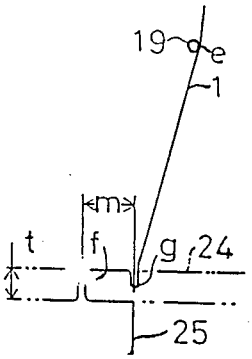
FIG. 6B shows a thread running path during the phase when fabric feeding is finished.
Figure 6C:
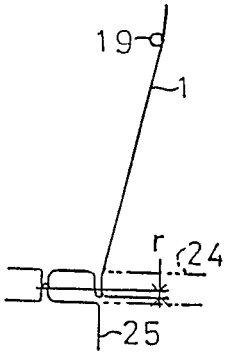
FIG. 6C shows a thread running path during maximum slackening of the thread.

Assuming that W is a supply length W of the upper thread to be supplied between the phases $\theta$ 1 and $\theta$ 2, the length of the thread must to be supplied, from the condition $\theta$ 1 where the preceding stitch is finished by tightening the thread, to the condition $\theta$ 2 where the needle eye 2*a* comes down to the center of the fabric thickness, that is the length of ""e - g - f" of FIG. 6(*b*) minus the length of "e - h - f" of FIG. 6(*a*). Assuming that P is the amount of the upper thread required by the feeding amount m shown with "f - g" and the fabric thickness t, as shown in FIG. 6(*b*) assuming that L is the length of the thread obtained by "e - h - f" of (FIG. 6(*b*) minus "e - g" of FIG. 6(*b*), and k is an elongation given by the upper thread tension device 6. Then the head amount W supplied between the phase $\theta$ 1 and the phase $\theta$ 2 can be expressed by $W=P-(L+k)$.

Since the upper thread is interlocked at the crossing point 23 at the center of the fabric thickness, the required length P of the upper thread is definicient of the length L+k. L is a value determined by an offset amount n of the thread guide 19 with respect to the center i of the needle as seen in FIG. 6(*a*) and the height v of the needle eye 2*a* at the upper dead point.

The amount k of the thread elongation may be varied in dependence upon a thread type and the pressure of the upper thread tension device 6. The tension device 6 may be set to hold the upper thread with a weak tension only to prevent the upper thread from running back through the upper thread tension device 6 while the intermittent presser device 9 is releasing the upper thread. Therefore, the differences in elongation for different types of threads are small, and the length L+k may be dealt with as being substantially constant in individual sewing machines. The required length of the upper thread is compensated, as shown in FIG. 6 by properly delaying the operation phase $\theta$ 2 of the intermittent presser device 9 which is kept released until the needle eye 2*a* comes down past the center of fabric thickness a determined amount r, and thus the thread amount of 2r may be supplied. The predetermined distance r is precalculated from equation $2r=L+k$, and the presser device is accordingly adjusted.

By this compensation, it is possible to supply the correct length of the upper thread corresponding to the length needed for stitches determined by the fabric feeding and the fabric thickness. Since the supply length is equal to the lacking length, the compensation will meet the sewing conditions including a change in the needle amplitude and fabric feeding amount for a fabric of a standard thickness.

Figure 14:
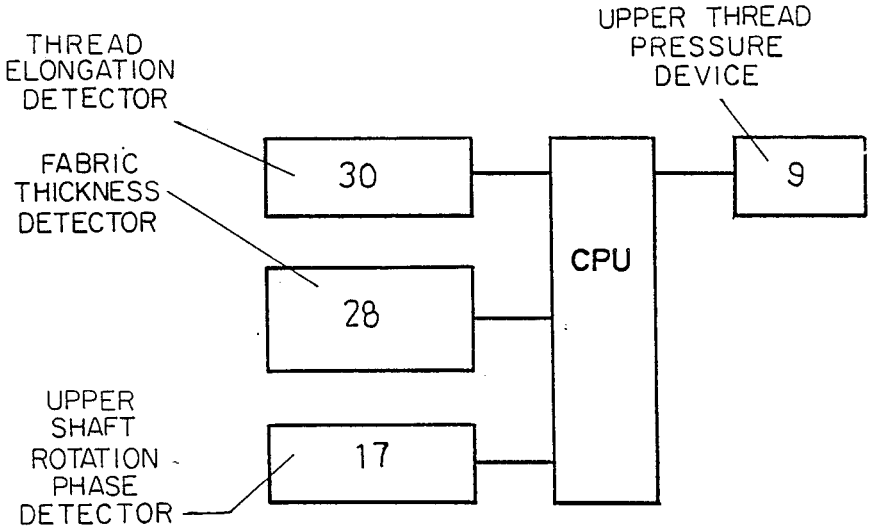
FIG. 14 is a block diagram of the control device for controlling advance of the upper thread.

The above stated explanation refers to the operation of the control mechanism of the automatic thread tension device of the sewing machine, and a further explanation will be made with reference to FIGS. 10, 11 and 14 which show an embodiment including a compensation device for advancing an upper thread in accordance with the fabric thickness and thread elongation.

Figure 10:
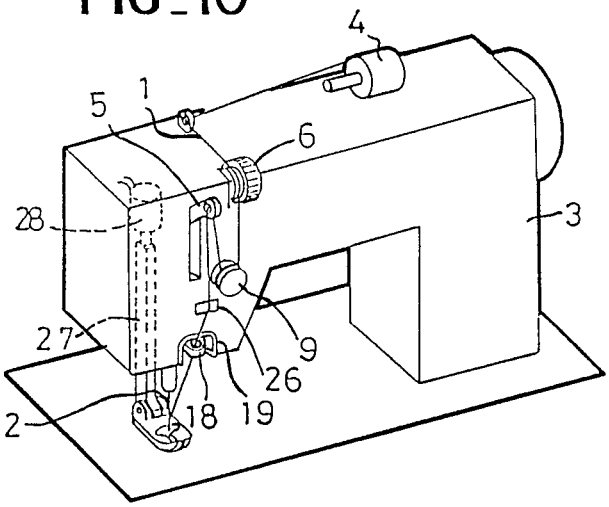
FIG. 10 is a perspective view of a sewing machine having a compensating device for compensating difference in thread elongation.
Figure 13:
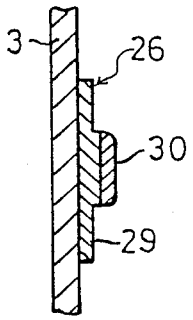
FIG. 13 is a cross-sectional view of the tension sensor.

A sewing machine shown in FIG. 10 is provided with a tension sensor 26 detecting a tension of the upper thread and a position sensor 28 detecting a vertical shift position of the presser bar 27. The tension sensor 26 has a structure as seen in FIG. 13, where a pressure sensor 30 is fixed on an attaching plate 29 on the machine frame 3, and when the upper thread is imparted with the tension upon elongation of the thread, the pressure sensor 30 detects stress or pressure and produces a variable electric signal communicated to CPU. The position sensor 28 is of a generally known structure, such as shown in, e.g., Japanese Pat. Publication No. 51,797/81. The presser bar 27 has a fabric presser foot mounted at the lower end thereof and is vertically shifted depending on the thickness of the fabric to be sewn. A plunger magnet is provided above the upper end of the presser bar 27 and the end of the plunger is operatively connected to the upper end of the presser bar so that vertical movement of the presser bar is transmitted to the plunger which is operated to produce the electric signal to the CPU.

The upper thread is effected with the elongation as the thread take-up lever 6 moves to the upper dead point, and the required length of thread is supplied by releasing the intermittent presser device 9. Therefore the elongation characteristic which is different for different types of threads, is detected by the tension sensor, and by changing the releasing operation of the intermittent presser device, the thread supplying length is decreased or increased. The CPU, in response to the electric signal from the position sensor 28, modified the thread releasing duration of the thread presser 9.

Figure 11:
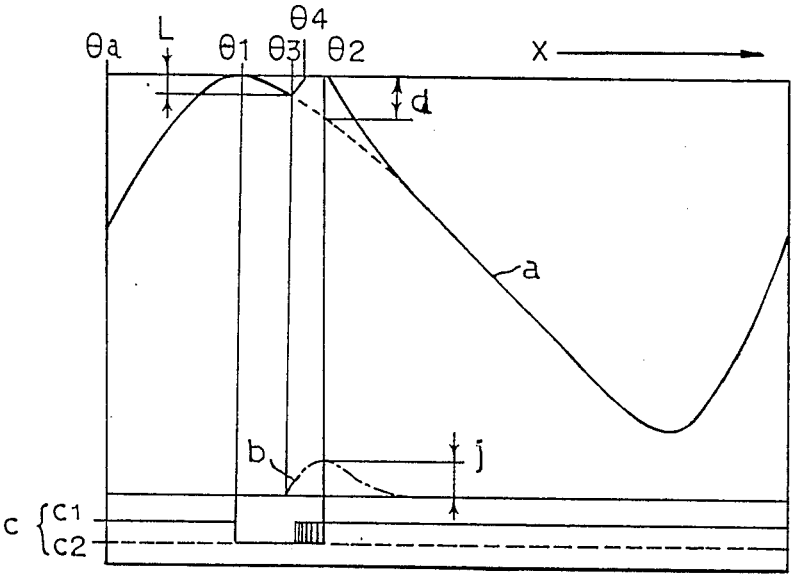
FIG. 11 is a diagrammatic view explaining slackening of the thread supplied by the take-up lever by a stitch compensating device according to the invention as dependent or rotational phases of the drive shaft.
Figure 12:
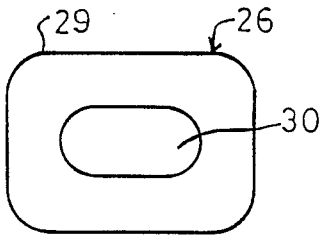
FIG. 12 is an enlarged view of a tension sensor.

FIG. 11 diagrammatically shows the upper thread tension control with the thread take-up lever 5, the auxiliary thread take-up lever 8, and the thread presser 9 arrives at the upper dead point at the rotation phase $\theta_1$ of the drive shaft 15. As in FIG. 7, the abscissa X and the ordinate Y denote rotation phase of the upper shaft 15 and the upper thread supplying movement of the thread take-up lever 5. The thread is elongated by a maximum length L which corresponds to the length used to make a stitch upon movement of the thread take-up lever 5 downward. The upper shaft rotation phase detector 17,17 detects the rotation phase $\theta_1$ and generates an electric signal. The control device (CPU), in response to the generated signal, causes the thread pressure 9 to release the upper thread from the thread source 4. When the rotation phase $\theta_3$ is reached, the auxiliary take-up lever 8 is actuated to absorb the length (j) of the upper thread which is equivalent to the length (d) supplied by the thread take-up lever 5 as the latter moves downward. It is to be noted that the thread elongation sensor 26 detects the tension of the upper thread which varies as the thread is elongated from a minimum to a maximum until the thread take-up lever 5 reaches the upper dead point of the rotation phase $\theta_1$ of the drive shaft 15. Therefore, the thread elongation detector 26 generates a variable electric signal which value changes from a minimum to a maximum in accordance with a change in thread elongation. The CPU, in response to the signal of maximum elongation, controls the thread presser 9 in such a way that the upper thread is released during a time determined by the value of the signal. Thus, the electric signal generated by the detector 26 determines the duration of thread-releasing operation of the thread presser 9. Therefore, if the thread-releasing duration is longer, the upper thread length advanced from the thread source 4 will increase. If the thread-releasing duration is shorter, the advanced length of the upper thread will decrease.

The position detector 28 detects a position of the fabric pressure bar 28 which varies depending on the thickness of the fabric to be sewn. Thus, the position detector also generates a variable electric signal. The CPU, in response to this signal, additionally modifies the thread-releasing duration of the thread presser 9 because the required length of the upper thread depends on a thickness of the fabric to be sewn.

Briefly, according to FIG. 11, as the thread take-up lever 5 comes up, the upper thread may be elongated by the maximum amount L until the thread take-up lever 5 comes up to the upper dead point thereof at the rotation angle $\theta$ 1 of the upper drive shaft 15 at which the presser device 9 is operated to release the upper thread.

In the meantime, the tension sensor 26 continuously produces an electric tension signal until the thread take-up lever 5 comes down and the thread elongation is dissolved to 0, generally between the phase $\theta$ 1 and the phase $\theta$ 3. As shown, the auxiliary thread take-up lever 18 is operated at the phase $\theta$ 3 to draw the slack amount of the upper thread between the needle and the thread take-up lever 5 to keep the thread tightened for the purpose mentioned with reference to FIG. 7. It is however noted that the elongation is variable depending upon the types as well as the natures of the threads, and therefore, the produced tension signal is variable accordingly.

Namely the phase is variable between the phase $\theta$ 1 and the phase $\theta$ 2 where the elongation is dissolved to 0. Such variable tension signal will determine the phase where the presser device 9 is operated to clamp the upper thread. The phase may be variable between the phase $\theta$ 4 and the phase $\theta$ 2 where the presser device 9 clamps the upper thread. The thread clamping phase may be further variable depending upon the thickness of the fabric to be sewn.

If the specific type of an upper thread is used, the thread elongation dissolved phase is determined between the phases $\theta$ 1 and $\theta$ 3, the phase is detected by the phase detecting means (photosensor 16, 17), which produces a phase detecting signal for reading out data stored in a memory of the CPU to control the solenoid 12 which operates the presser device 9 to clamp the thread at the phase. Similarly the vertical position sensor 28 detects the thickness of the fabric to be sewn and produces an electric signal which, in association with the phase detecting signal, reads out another data from the memory to control the solenoid 12 to further change the thread clamping phase of the presser device 9.

There is a difference in upper thread supply operations performed according to FIG. 7 and FIG. 11, respectively. FIG. 7 shows diagrammatically thread supply as disclosed in U.S. application Ser. No. 07/312,899 discussed in the preamble of the present application. Namely, FIG. 7 is shown to explain how to supply the most proper amount of an upper thread required to form the generally most desired stitch in the fabric of a standard thickness. On the other hand, FIG. 11 is shown to explain how to supply the most proper amount of the upper thread which may be variable depending upon the type of the upper thread and the thickness of the fabric to be sewn.

What is claimed is:

1. A sewing machine comprising a needle holding an upper thread; a drive shaft rotatable to vertically reciprocate the needle holding an upper thread; means for carrying a lower thread and catching the upper thread to form lock stitches in cooperation with the needle; a source of the upper thread; a main thread take-up lever operated in synchronism with the needle to tighten and slacken the upper thread; a presser bar having a presser foot mounted at a lower end thereof and vertically shiftable to a variable position depending upon a thickness of a fabric to be sewn; an upper thread tension member arranged in an upper thread running path between said upper thread source and said main thread take-up lever; an auxiliary thread take-up lever arranged in the upper thread running path between said main thread take-up lever and said needle and having a thread engaging part for guiding the upper thread; a thread presser arranged laterally of the upper thread running path between said main and auxiliary thread take-up levers and normally clamping the upper thread; means for detecting a predetermined rotation phase of said drive shaft and producing an electric signal; control means responsive to the electric signal of said detecting means to cause said thread presser to release the upper thread; thread elongation detecting means arranged in the upper thread running path between said main and auxiliary thread take-up levers and generating an electric signal in response to an elongation of the upper thread caused by said main thread take-up lever during sewing operation, said control means determining the duration in which said thread presser releases the upper thread in response to the electric signal of said thread elongation detecting means; a thread guide fixedly arranged adjacent to said auxiliary thread take-up lever, said auxiliary thread take-up lever being controlled in association with said drive shaft for movement relative to said thread guide into a position in which said thread engaging part cooperates with said thread guide to absorb a slack amount of the upper thread in said thread running path between said main thread take-up lever and said needle while said thread presser releases the upper thread.

2. A sewing machine as defined in claim 1, further comprising fabric thickness detecting means for detecting a variable vertical position of said presser bar and for generating an electric signal, said control means modifying the duration in which said thread presser releases the upper thread in response to the electric signal of said fabric thickness detecting means.

3. An automatic thread tension adjusting device for a sewing machine including a needle holding an upper thread, a drive shaft rotatable to vertically reciprocate the needle holding an upper thread, means for carrying a lower thread and catching the upper thread to form lock stitches in cooperation with the needle, a source of the upper thread, a main thread take-up lever operated in synchronism with the needle to tighten and slacken the upper thread, and a presser bar having a presser foot mounted at a lower end thereof and vertically shiftable to a variable position depending upon a thickness of a fabric to be sewn, said automatic thread tension adjusting device comprising an upper thread tension member arranged in an upper thread running path between the upper thread source and the main thread take-up lever; an auxiliary thread take-up lever arranged in the upper thread running path between the main thread take-up lever and the needle and having a thread engaging part for guiding the upper thread; a thread presser arranged laterally of the upper thread running path between the main and auxiliary thread take-up levers and normally clamping the upper thread; means for detecting a predetermined rotation phase of the drive shaft and producing an electric signal; control means responsive to the electric signal of said detecting means to cause said thread presser to release the upper thread; thread elongation detecting means arranged in the upper thread running path between the main and auxiliary thread take-up levers and generating an electric signal in response to an elongation of the upper thread caused by the main thread take-up lever during sewing operation, said control means determining the duration in which said thread presser releases the upper thread in response to the electric signal of said thread elongation detecting means; a thread guide fixedly arranged adjacent to said auxiliary thread take-up lever, said auxiliary thread take-up lever being controlled in association with said drive shaft for movement relative to said thread guide into a position in which said thread engaging part cooperates with said thread guide to absorb a slack amount of the upper thread in the thread running path between the main thread take-up lever and the needle while said thread presser releases the upper thread.

* * * * *